US006161538A

United States Patent [19]

Bonhomme et al.

[11] Patent Number: 6,161,538

[45] Date of Patent: Dec. 19, 2000

[54] INDIVIDUAL EQUIPMENT FOR PROTECTION AGAINST NBC THREATS

[75] Inventors: Jean-Philippe Bonhomme, Versailles; Jean-Claude Urgel, Les Chesnay; Alain Garnier, Dannemarie, all of France

[73] Assignee: Intertechnique, Plaisir, Cedex, France

[21] Appl. No.: 09/072,188

[22] Filed: May 5, 1998

[30] Foreign Application Priority Data

May 6, 1997 [FR] France ..... 97 05566

[51] Int. Cl.[7] ..... A62B 17/04

[52] U.S. Cl. ..... 128/204.21; 128/204.22; 128/204.23; 128/206.27; 128/207.11

[58] Field of Search ..... 128/201.22, 201.23, 128/201.25, 201.29, 206.23, 206.27, 206.28, 207.11, 202.27, 201.24; 2/6.2

[56] References Cited

U.S. PATENT DOCUMENTS

| | | | |
|---|---|---|---|
| 2,935,985 | 5/1960 | Andrews et al. | 128/201.23 |
| 3,259,127 | 7/1966 | Klinger et al. | 128/206.23 |
| 4,926,854 | 5/1990 | Bode | 128/201.23 |
| 5,279,286 | 1/1994 | Chen | 128/201.19 |
| 5,575,278 | 11/1996 | Bonhomme et al. | 128/201 |
| 5,630,412 | 5/1997 | Dubruille et al. | 128/201.22 |
| 5,720,281 | 2/1998 | Allen et al. | 128/206.23 |

FOREIGN PATENT DOCUMENTS

| | | |
|---|---|---|
| 0371858 | 6/1990 | European Pat. Off. . |
| 2706257 | 12/1994 | France . |
| 2707141 | 1/1995 | France . |

*Primary Examiner*—John G. Weiss
*Assistant Examiner*—V. Srivastava
*Attorney, Agent, or Firm*—Larson & Taylor PLC

[57] ABSTRACT

The equipment has a helmet, a full face-cover fitted with fastenings for fixing it to the helmet, and with a coupling for connection to a breathable gas feed hose. It also has a flexible envelope extending the helmet and the face-cover downwards. For leakproof junction between the helmet, the face-cover and the envelope, a hoop is sealingly connected to the helmet. It has a lower branch which constitutes a closed bottom loop for receiving the envelope and a transverse branch having one side designed to sealingly receive the shell of the helmet and an opposite side which sealingly receives the face-cover. A plug rigidly fixed to the face-cover and placed in a vertical midplane of the face-cover, at the bottom thereof, engages a socket pivotally connected to the hoop. Lateral fasteners complete the connection.

9 Claims, 4 Drawing Sheets

FIG.1.(PRIOR ART)
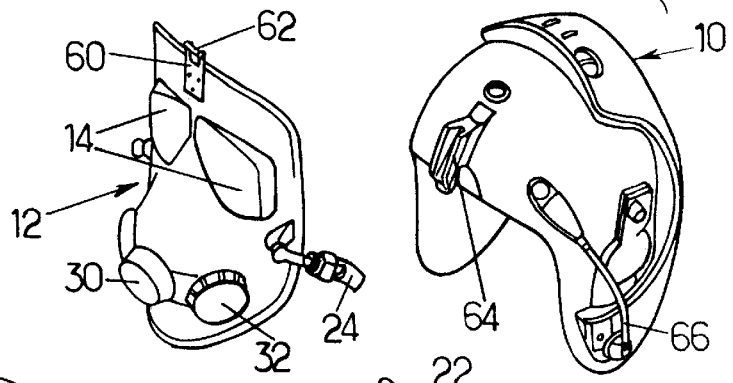
FIG.7.
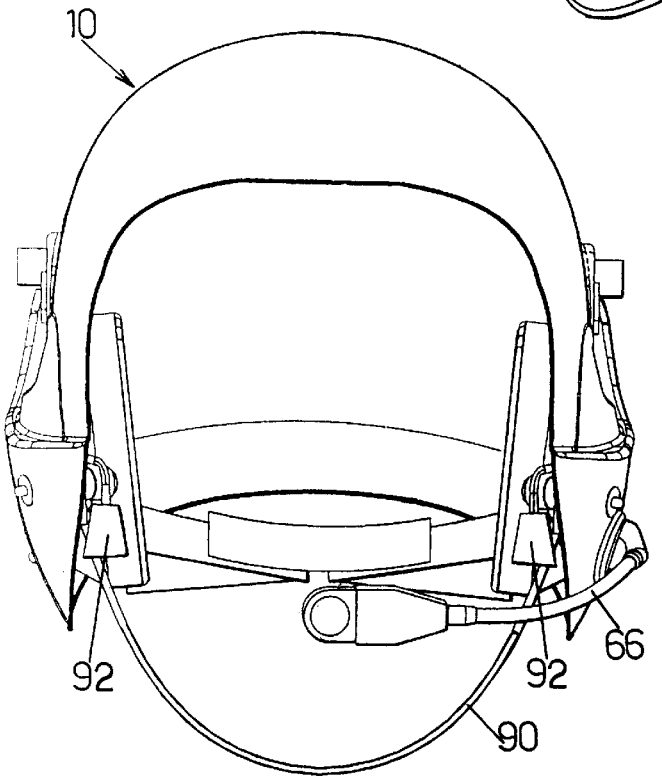
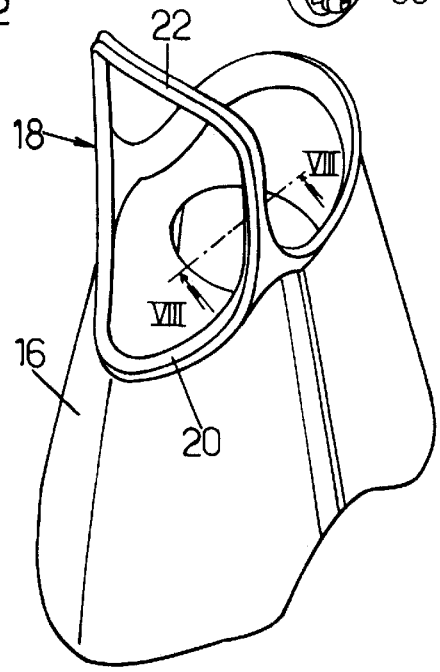
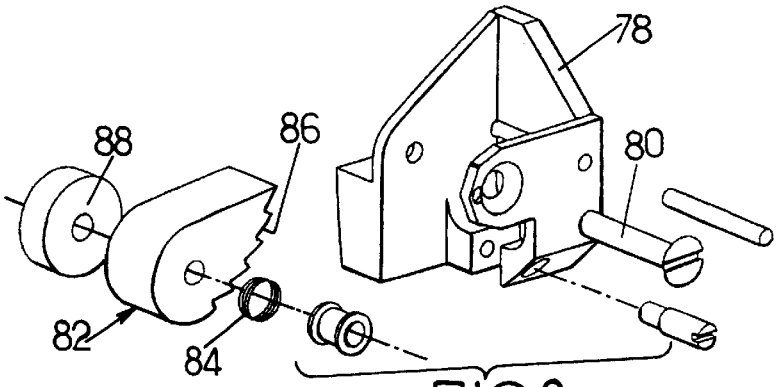
FIG.8.

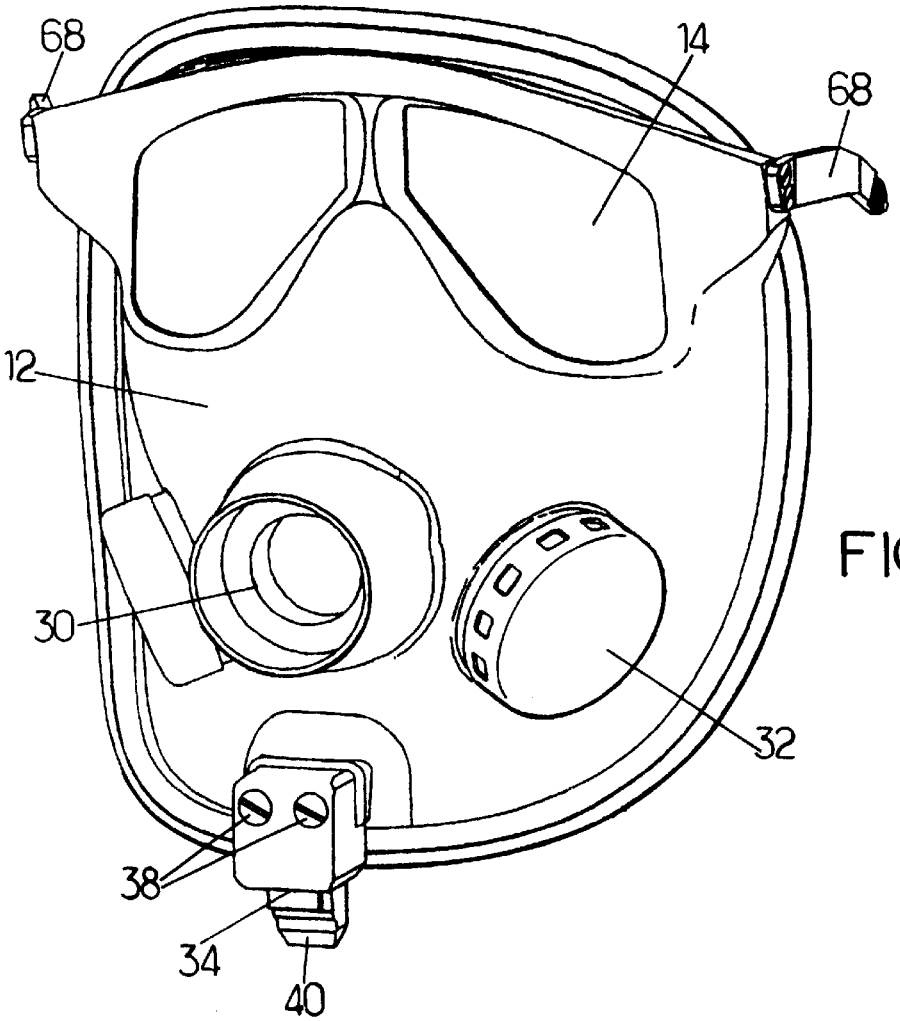
FIG.3.
FIG.5.
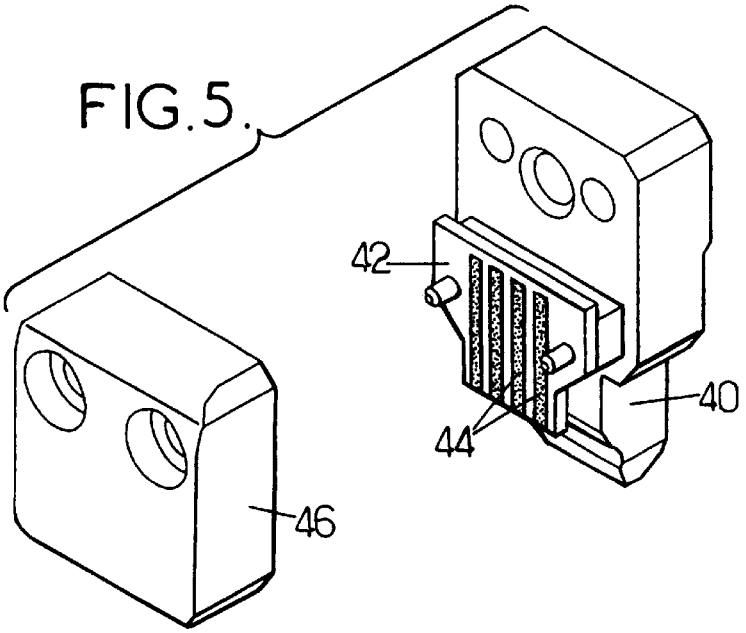

FIG.6.
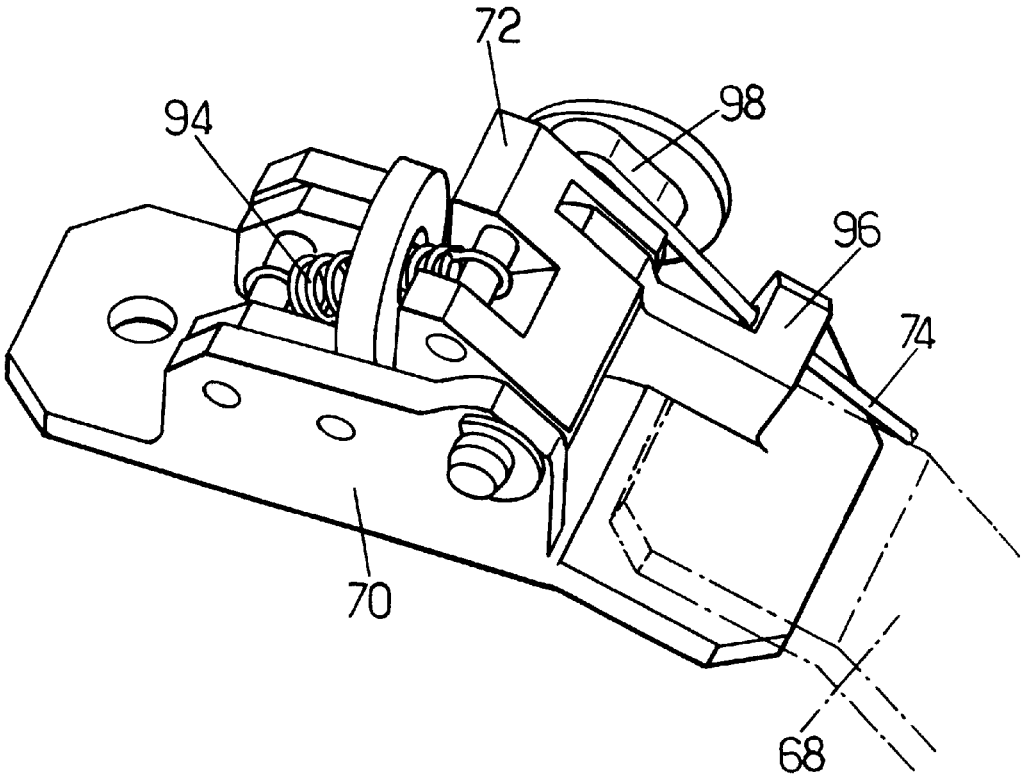
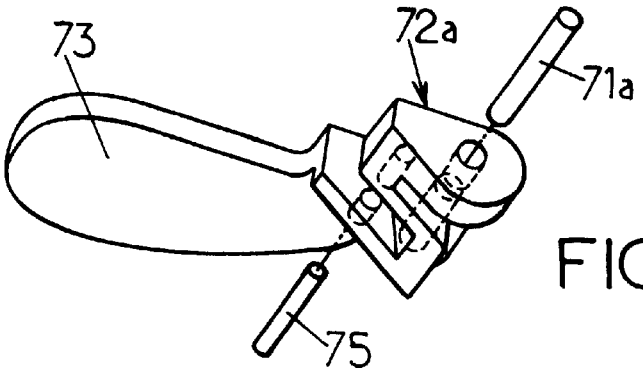
FIG.6A.

INDIVIDUAL EQUIPMENT FOR PROTECTION AGAINST NBC THREATS

BACKGROUND OF THE INVENTION

The present invention relates to individual equipment for protecting personnel exposed to so-called "NBC" threats (threats of nuclear, bacteriological, or chemical contamination).

In general, such individual equipment comprises a helmet, a complete face-cover fitted with fastenings for fixing to the helmet, and a coupling for a breathing or ventilation gas feed hose, and a flexible envelope, often called a "neck seal", that extends the helmet and the face-cover downwards, together with means for providing a leakproof connection between the helmet, the face-cover, and the envelope. The helmet provides protection against perforation and against shock, and it also serves as a support for various elements such as earphones and a transparent visor.

This structure enables personnel to use only the helmet when performing a mission that does not include an NBC threat. This avoids the discomfort of the elements of items of equipment that completely envelop the face and the neck. However, when personnel is informed prior to a mission that there is a risk of NBC attack, then the envelope is fitted to the helmet. When the presence of an actual threat is indicated, either by sensor means carried by a vehicle occupied by personnel, or else on receipt of a message, the user engages the face-cover and secures it to the helmet, after switching on the ventilation system for supplying filtered air or the system for supplying breathing gas. The first situation arises in particular in helicopters that operate at low altitude and that are consequently not fitted with a source of oxygen under pressure, and it also occurs on military transport that operate at moderate altitude.

To avoid the existence of a "triple" point, where the helmet, the face-cover, and the envelope are interconnected directly, U.S. Pat. No. 5,575,278 (Bonhomme et al.) describes equipment in which the means for providing a leakproof connection between the helmet, the face-cover, and the envelope comprise a monolithic hoop removably connected to the helmet, having a lower branch that constitutes a closed bottom loop for receiving the envelope and a transverse branch constituted on one side to fit to the shell of the helmet and on its opposite side to receive a gasket of the face-cover.

In a particular embodiment described in U.S. Pat. No. 5,575,278, the face-cover includes an upwardly projecting yoke having a transverse pin, while the helmet has a fork designed to receive the pin. The connection by means of a pin and a fork is complemented by lateral fastenings carried by the face-cover and engaged on the helmet.

SUMMARY OF THE INVENTION

An object of the invention is to provide individual protection equipment having a face-cover which can easily be put into place and removed while using one hand only, under conditions that might be critical and that require action to be taken quickly.

To this end, the invention provides equipment of the type described above, in which the means for fixing the face-cover in place comprise:

a plug assembly securely fixed to the face-cover, placed in a vertical midplane of the face-cover and at the bottom thereof, which plug assembly is engageable and disengageable by sliding into and out from a socket which is pivotally connected to the hoop; and lateral fastenings.

With such a structure, the wearer of the helmet can look down and see the socket and the plug and can monitor insertion visually.

For easier insertion, the lateral fastenings may include racks fixed to the face-cover and housings fixed to the hoop and designed to receive the racks slidably, the housings being provided with pawls urged resiliently into engagement with the racks during insertion of the racks.

With such a structure, the wearer of the helmet has just to swing back the face-cover about the axis of rotation of the socket to engage the lateral fastenings.

For easier removal of the mask, the pawls may be connected to string means for exerting traction against the resilient force of the resilient means, thereby releasing the racks, or to finger actuatable levers.

The invention will be better understood on reading the following description of an embodiment given by way of non-limiting example. The description refers to the accompanying drawings.

BRIEF DESCRIPTION OF THE DRAWINGS

FIG. 1 is an exploded view showing the general structure of prior art equipment;

FIGS. 2 and 3 are perspective views of the hoop and of a face-cover of equipment constituting an embodiment of the invention;

FIG. 5 is an exploded view of a plug usable with the FIG. 4 socket;

FIGS. 6 and 6A is a perspective view of a housing for a lateral fastening of the face-cover;

FIG. 7 is a front view of a helmet particularly adapted for use with a face-cover and a hoop as shown in FIG. 2; and FIG. 8 is an exploded view of a jam cleat carried by the helmet of FIG. 7.

Figure 2:
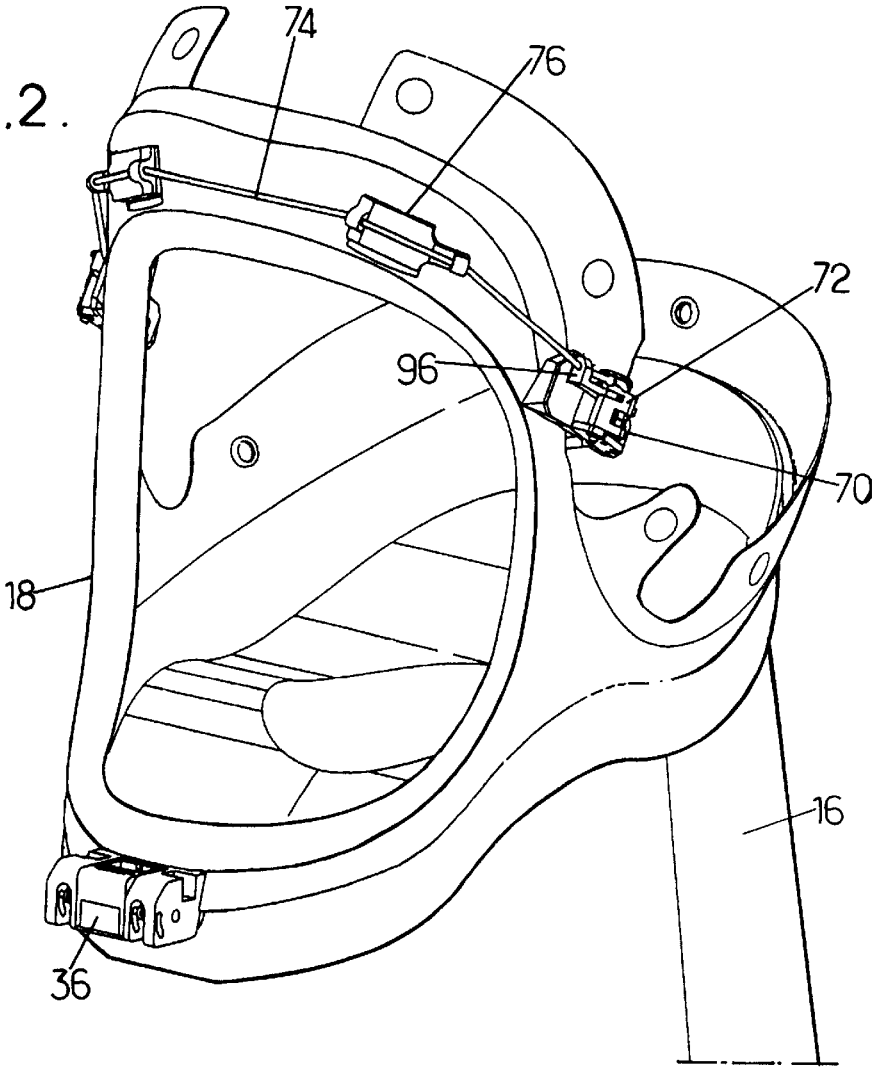

The equipment of the invention may be considered as an improvement to the equipment described in U.S. Pat. No. 5,575,278, to which reference may be made. The invention relates more particularly to equipment having the general structure shown diagrammatically in FIG. 1. The equipment comprises a helmet 10, a face-cover 12 having a transparent visor or goggles 14, and an envelope 16. The face-cover has a breath-out valve 32, an endpiece 30 for coupling to a flexible air feed hose, and optionally an endpiece for supplying drink, located symmetrically to the valve 32 about the vertical midplane of the face-cover. The equipment also includes a hoop 18 designed to allow the helmet 10, the face-cover 12, and the envelope 16 to be interconnected in leakproof manner.

As shown, the hoop 18 is removable and is made as a single piece. It comprises a lower branch 20 in the form of a closed loop designed to receive the envelope 16, and a transverse branch 22 that is U-shaped and designed so that one of its sides fits to the helmet 10 while its other side fits to the face-cover.

For missions during which NBC threats are not expected, the person to be protected wears the helmet only.

However, if a potential NBC threat exists, then the person to be protected, e.g. a helicopter pilot, fits the envelope 16 and the hoop 18 to the helmet 10 before putting on the helmet.

If an NBC threat is indicated by sensors or by telecommunications, the pilot dons the face-cover 12, the face-cover is provided with fastenings 24 suitable for holding the cover pressed against the hoop 18.

As a result, the various leakproof junctions that are required do not include mutual connections that give rise to a triple point where leaks are prone to occur.

In the equipment of FIG. 1, the means for fixing the face-cover 12 comprise a yoke 60 that projects upwards, having a transverse pin 62. The helmet 10 has a fork 64 designed to receive the pin 62 when the face-cover is slided upwards along the upper portion of the transverse branch 22. Once the face-cover is properly in place, it can be secured to the helmet by means of the fastenings 24, preferably adjustable in length.

Before donning the face-cover, the wearer tilts up a boom 66 carrying a microphone from a position in front of the mouth.

In FIG. 2 (where elements corresponding to those of FIG. 1 are given the same reference numerals) the hoop 18 is again integral with the envelope 16. The face-cover 12 (FIG. 3) and the hoop 18 are provided with means for air-tight mutual connection.

Figure 4:
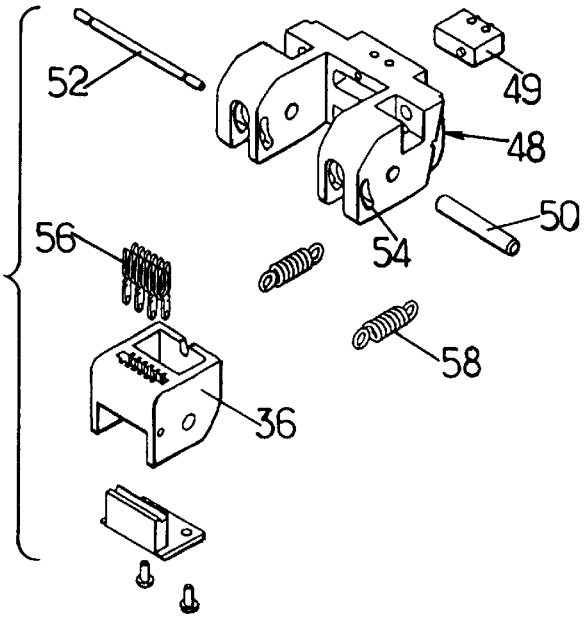
FIG. 4 is an exploded view of an advantageous embodiment of the FIG. 2 socket.

A first set of connecting means comprises a plug unit 34 on the face-cover (FIGS. 3 and 5) and a socket 36 pivotally connected to the hoop for pivotal movement about a horizontal axis (FIGS. 2 and 4).

The plug unit 34 is permanently fixed to the face-cover 12, e.g. by means of screws 38. As a general rule it comprises a plurality of parts that are assembled together, including a finger 40 and a plate 42 of insulating material constituting a printed circuit carrying conductive tracks 44. The conductive tracks are connected to a microphone located inside the face-cover (not shown). A block 46 constitutes an abutment that determines the extent to which the plug can be inserted into the socket.

The socket 36 is placed between the arms of a U-shaped support 48 for pivotal movement about an axle 50 located in the support. The range through which the socket can pivot is limited by a pin 52 which passes through the socket and which comes into abutment against the ends 54 of slots formed in the support arm 48. A groove is provided in this socket to receive terminals 56 which co-operate with the conductive tracks 44 of the plug and which are normally connected to an audio circuit connected to a microphone mounted on a boom, similar to the boom 66 of FIG. 1. Springs 58 secured to the socket 36 and to the support 48 urge the socket rearwards. However, the connection between the tilting socket and the support includes means for retaining the socket in a forwardly-inclined position when it is manually moved into such a position.

The second set of fixing means comprises two racks 68 fixed laterally to a top portion of the face-cover (FIG. 3). The racks are placed in such a position as to be received in housings 70 fixed to the hoop and each having a pawl 72 urged resiliently towards a position in which it engages the corresponding rack when the rack is inserted therein, so as to prevent removal of the rack. To enable the wearer to release both pawls simultaneously, the pawls are interconnected by a string 74 which passes through guides 76 carried by the top portion of the face-cover.

Each housing can have the structure shown in FIG. 6. The pawl 72 pivots on the housing which is fixed to the hoop. A spring 94 urges the pawl towards a position in which it engages the rack when the rack is inserted. The string 74 is guided via an eyelet 96 belonging to the housing, is deflected over a curved surface 98, and is connected to the end of the pawl.

In the modified embodiment of FIG. 6A, the pawl 72*a* has a flat lever 73 for rotating it about an axle 71*a* carried by the housing. A return spring is connected to a pin 75 secured across the pawl.

The connecting structure shown in FIGS. 2 to 5 makes it possible for the face-cover to be done and undone easily, even when using one hand only. The person desiring to put the face-cover into place takes hold of it in one hand and inserts the plug 34 into the socket 36. This operation can be monitored visually, since the socket points forwards and lies in the field of view of the wearer of the helmet. Thereafter, the wearer tilts the face-cover backwards until the racks engage in the respective housings 70 and are locked in a position where there is sufficient contact pressure to ensure sealing.

Typically, the support 48 contains a switch 49 to switch the audio circuit of the helmet from a microphone carried on a boom to a microphone placed inside the face-cover, when the socket is tilted together with the face-cover.

To remove the face-cover, the wearer pulls on the string 74. Under such circumstances, the resilience of the gaskets and the weight of the face-cover cause it to move forwards. It can then be removed using one hand only by tilting it further forwards and then taking it away.

Frequently, the helmet of a crew member is held on the head by means of a chin-strap or a throat-strap connected to the outside of the shell of the helmet. If such a helmet is used with a full face-cover, e.g. under NBC conditions, then the chin-strap needs to pass through the face-cover, and that can reduce air tightness. This problem can be overcome by attaching the chin-strap to the inside of the helmet. In the embodiment shown in FIGS. 7 and 8, the chin-strap is retained on the helmet by a pair of jam cleats similar to those used in sailing dinghies for holding the sheets of sails. With reference again to FIG. 8, it can be seen that each cleat has a U-shaped support 78 fixed to the inside of the shell of the helmet 10. A pin 80 interconnecting the arms of the support 78 pivotally supports a wedge 82 urged by a spring 84 in a direction that brings a serrated surface 86 of the wedge towards the web of the support. The pin 80 also caries a roller 88 adjacent to the wedge.

The chin-strap 90 (FIG. 7) passes between the web of each support and the corresponding wedge for holding it. By moving the end portions of the chin-strap away from the midplane of the helmet, they are released and free to slide. Tabs 92 fixed to the ends of the strap are placed so as to be grasped by the wearer of the helmet.

With such a structure, it is possible to tighten the chin-strap by pulling simultaneously on the two tabs and to lock it by pulling the end portions laterally beneath the wedges 82. The strap can be released with one hand only by pulling one of the tabs away from the midplane of the helmet.

The members of an aircraft or helicopter crew need to balance pressure in the inner ear during rapid loss of altitude. This is commonly performed by a "VASALVA" maneuver. The person clamps his nose with one hand and blows until the ears "pop". Such a maneuver can no longer be performed under NBC conditions, since the face cover prevents access to the nose.

To make such pressure balancing possible, the breathe-out valve 32 can be fitted with means enabling it to be closed deliberately and the terminal part of the endpiece 30 of the face-cover can be fitted with a non-return valve. The means for forcibly closing the breathe-out valve may comprise a cover or cap which closes the breathe-out valve mechanism when turned by hand. It is then possible for the wearer of the equipment to increase the pressure in the breathing duct. For this purpose, the breathe-out valve is closed, thereby enabling pressure to rise since the air or oxygen that is breathed out can no longer escape. If necessary, the wearer can press the face-cover against the face to improve airtightness. Once the ears have "popped", the wearer releases the cover (if it is resiliently urged towards its normal operating position), or turns it in the opposite direction, to reestablish normal operation.

What is claimed is:

1. Individual protection equipment for use against nuclear-biological-chemical threats, comprising:

a helmet;

a full face-cover provided with fastening means for connection to the helmet and with a coupling for a breathing gas feed;

a flexible envelope extending from the helmet and the face-cover downwards; and means for providing an air-tight connection between the helmet, the face-cover, and the envelope;

wherein said means for air-tight connection comprise a one-part hoop sealingly connectable to the helmet and separable therefrom, having a lower branch constituting a closed bottom loop for receiving the envelope, and a transverse branch having one side constructed for airtight connection with a shell of the helmet and an opposite side constructed for an air-tight removable connection with the face-cover and wherein said fastening means comprise:

a plug unit securely fixed to the face-cover, placed in a vertical midplane of the face-cover and at a bottom thereof, a socket pivotally connected to the hoop into which said plug unit is slidably engageable and disengageable, said socket being pivotally mounted on a U-shaped support fixed to the hoop and being connected to the U-shaped support by resilient means urging the socket rearwards; and lateral fastenings.

2. Equipment according to claim 1, wherein the plug unit and the socket have co-operating means for connecting an audio circuit of the helmet to a microphone carried inside the face-cover responsive to insertion of the plug into the socket.

3. Equipment according to claim 2, further comprising an electrical switch cooperating with the socket so as to switch a connection of the audio circuit between said microphone in said face-cover and a microphone carried by a boom pivotally mounted on the helmet, upon rearward pivotal movement of the socket.

4. Equipment according to claim 1, wherein the helmet has a pair of cleats, each comprising a U-shaped support fixed to the inside of a helmet shell, and a respective wedge pivotally mounted on the U-shaped support and having a serrated surface for retaining one end of a chin or throat strap.

5. Equipment according to claim 1, wherein the envelope is securely permanently fastened to said lower branch.

6. Individual protection equipment for use against nuclear-biological-chemical threats, comprising:

a helmet;

a full face-cover provided with fastening means for connection to the helmet and with a coupling for a breathing as feed;

a flexible envelope extending from the helmet and the face-cover downwards; and means for providing an air-tight connection between the helmet, the face-cover, and the envelope;

wherein said means for air-tight connection comprise a one-part hoop sealingly connectable to the helmet and separable therefrom, having a lower branch constituting a closed bottom loop for receiving the envelope, and a transverse branch having one side constructed for air-tight connection with a shell of the helmet and an opposite side constructed for an air-tight removable connection with the face-cover and wherein said fastening means comprise a plug unit securely fixed to the face-cover, placed in a vertical midplane of the face-cover and at a bottom thereof, a socket connected to the hoop into which said plug unit is slidably engageable and disengageable, and lateral fastenings which comprise racks fixed to the face-cover and housings fixed to the hoop and designed to receive the racks slidably, the housings being provided with pawls urged resiliently into engagement with the racks during insertion of the racks.

7. Equipment according to claim 6, wherein the pawls are connected together by string means arranged to transmit manual traction and to release the pawls against the action of the resilient means.

8. Individual protection equipment for use against nuclear-biological-chemical threats, comprising:

a helmet:

a full face-cover provided with fastening means for connection to the helmet and with a coupling for a breathing gas feed;

a flexible envelope extending from the helmet and the face-cover downwards; and means for providing an air-tight connection between the helmet, the face-cover, and the envelope;

wherein said means for air-tight connection comprise a one-part hoop sealingly connectable to the helmet and separable therefrom, having a lower branch constituting a closed bottom loop for receiving the envelope, and a transverse branch having one side constructed for airtight connection with a shell of the helmet and an opposite side constructed for an air-tight removable connection with the face-cover and wherein said fastening means comprise a plug unit securely fixed to the face-cover, placed in a vertical midplane of the face-cover and at a bottom thereof, a socket connected to the hoop into which said plug unit is slidably engageable and disengageable, and lateral fastenings, and wherein the face cover has a breathe out valve fitted with a non-return valve and manually actuatable means for forcing the breathe-out valve into a closed position.

9. Equipment according to claim 8, wherein said means for closing the breathe-out valve comprise a cover which closes the breathe-out valve when turned manually away from a rest position.

* * * * *